US011506009B2

(12) United States Patent
Inglis et al.

(10) Patent No.: US 11,506,009 B2
(45) Date of Patent: Nov. 22, 2022

(54) REMOTE OPENING TOOL

(71) Applicant: Halliburton Energy Services, Inc., Houston, TX (US)

(72) Inventors: Peter D W Inglis, Tayside (GB); Katherine Ann Davies, Angus (GB)

(73) Assignee: Halliburton Energy Services, Inc., Houston, TX (US)

( * ) Notice: Subject to any disclaimer, the term of this patent is extended or adjusted under 35 U.S.C. 154(b) by 546 days.

(21) Appl. No.: 16/491,504

(22) PCT Filed: Dec. 5, 2018

(86) PCT No.: PCT/US2018/064043
§ 371 (c)(1),
(2) Date: Sep. 5, 2019

(87) PCT Pub. No.: WO2020/117226
PCT Pub. Date: Jun. 11, 2020

(65) Prior Publication Data
US 2021/0381326 A1 Dec. 9, 2021

(51) Int. Cl.
*E21B 23/04* (2006.01)
*E21B 34/08* (2006.01)

(52) U.S. Cl.
CPC ..... *E21B 23/04* (2013.01); *E21B 34/08* (2013.01); *E21B 2200/04* (2020.05)

(58) Field of Classification Search
CPC .... E21B 23/04; E21B 23/0412; E21B 23/042; E21B 2200/04
See application file for complete search history.

(56) References Cited

U.S. PATENT DOCUMENTS 3,967,647 A * 7/1976 Young ..... E21B 34/045 166/368
4,197,879 A 4/1980 Young
(Continued)

FOREIGN PATENT DOCUMENTS

GB 2425141 1/2009
WO 2014043028 3/2014

OTHER PUBLICATIONS

International Application No. PCT/US2018/064043, "International Search Report and Written Opinion", dated Aug. 26, 2019, 10 pages.
(Continued)

*Primary Examiner* — Cathleen R Hutchins
(74) *Attorney, Agent, or Firm* — Kilpatrick Townsend & Stockton LLP

(57) ABSTRACT

An actuation assembly positionable within a wellbore may comprise a primary piston coupled to a first spring. The primary piston may be positionable in a first position in which it is coupled to a release latch for restraining the release latch from actuating a ball valve mechanism. The actuation assembly may also include a locking piston coupled to a second spring and a locking mechanism positioned between the primary piston and the locking piston. The locking mechanism may be moveable between a restrained position and an unrestrained position, wherein in the restrained position the locking mechanism prevents the primary piston from moving a predetermined amount in a first direction in response to an application of pressure from a surface of the wellbore that is greater than a predetermined amount of pressure.

20 Claims, 4 Drawing Sheets

(56) References Cited

U.S. PATENT DOCUMENTS

| | | | | |
|---|---|---|---|---|
| 4,254,836 | A | 3/1981 | Russell | |
| 4,293,038 | A | 10/1981 | Evans | |
| 4,542,792 | A * | 9/1985 | Akkerman | E21B 34/102 166/323 |
| 4,550,780 | A | 11/1985 | Mott | |
| 6,378,612 | B1 | 4/2002 | Churchill | |
| 7,926,575 | B2 | 4/2011 | Ringgenberg et al. | |
| 2010/0051289 | A1 | 3/2010 | Constantine et al. | |
| 2012/0018172 | A1 | 1/2012 | Javed | |
| 2012/0118579 | A1 | 5/2012 | Murray et al. | |
| 2015/0285043 | A1 | 10/2015 | Airey et al. | |
| 2016/0003005 | A1 | 1/2016 | Pickle et al. | |

OTHER PUBLICATIONS

U.S. Appl. No. 16/491,266 , Non-Final Office Action, dated Sep. 23, 2021, 9 pages.

* cited by examiner

REMOTE OPENING TOOL

TECHNICAL FIELD

The present disclosure relates generally to downhole tools including ball valve mechanisms positioned downhole in a well system, and more specifically, though not exclusively, to an actuator assembly which provides for remote opening of a ball valve mechanism of a downhole tool.

BACKGROUND

A well system (e.g., oil or gas wells for extracting fluids from a subterranean formation) may include tools having ball valve mechanisms positioned downhole, for example tools having ball valve mechanisms. These tools may be actuated from a surface of a wellbore of the well system. Tools can include, but are not limited to, fluid loss control valves having ball valve mechanisms.

DETAILED DESCRIPTION

Figure 1:
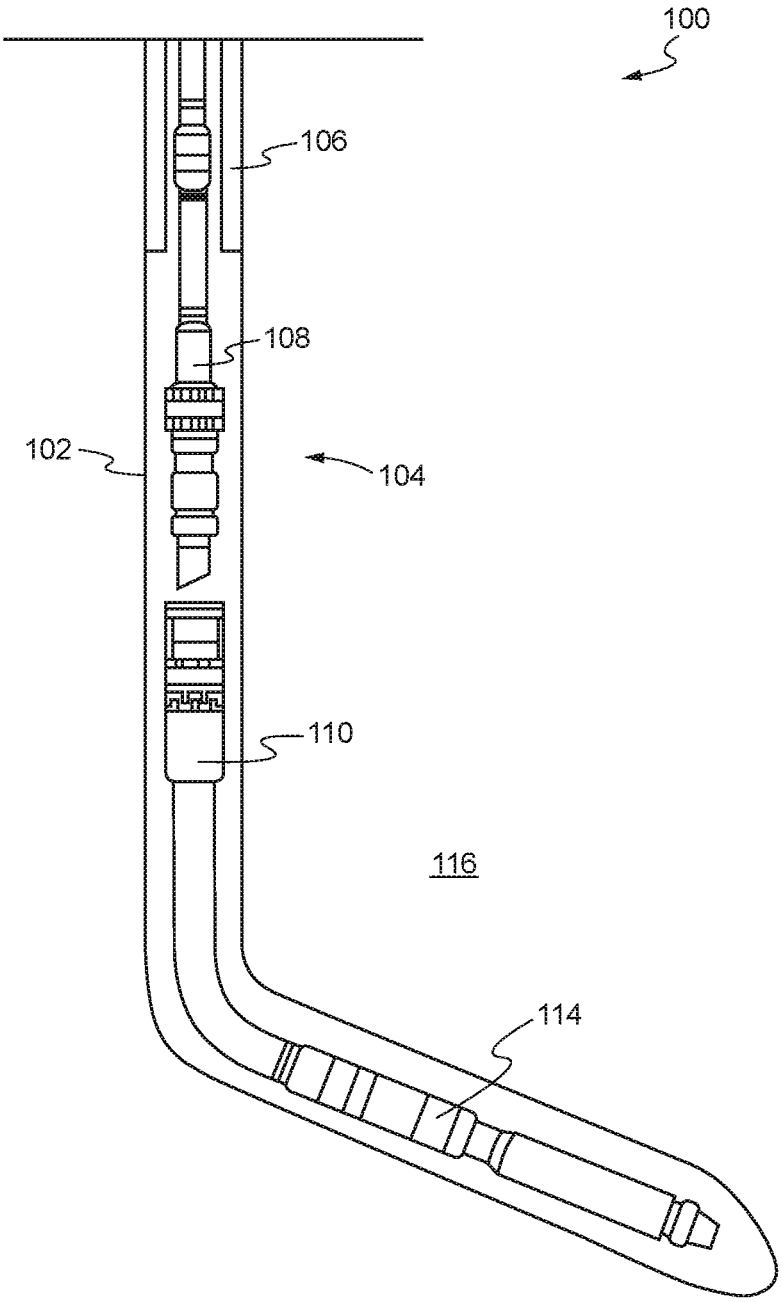
FIG. 1 is a schematic illustration of a well system including a downhole tool, according to an aspect of the present disclosure.

Certain aspects and examples of the disclosure relate to controlling a ball valve mechanism of a downhole tool positioned within a wellbore. The ball valve mechanism can selectively provide fluid flow between an interior region of a tubing string of the downhole tool and an annulus. In some aspects, in a closed position the ball valve mechanism can isolate the formation before an upper completion is installed in the wellbore of a well system. In the open position, fluid may flow through from the annulus into the interior of the tubing string. The ball valve mechanism may be actuated from a surface of the wellbore by applying a pressure signal that falls within a predetermined pressure window. The pressure window may be defined as a predetermined amount of pressure. In some aspects, the predetermined amount of pressure may be a range of pressures (also referred to as a pressure range). In some aspects, the pressure window for actuating the downhole tool may also include a predetermined amount of time that the predetermined amount of pressure is maintained. The ball valve mechanism may be actuated in response to a pressure signal within the predetermined pressure window being applied from the surface.

The downhole tool may be a fluid control device or any other device comprising a ball valve mechanism. The actuator assembly for the downhole tool can include a series of springs, pistons, and latches that are arranged to retain a release latch in place when a pressure signal from a surface of a wellbore falls outside of a predetermined pressure window. The release latch can be released by the series of springs, pistons, and latches when the pressure signal from the surface falls within the predetermined pressure window.

In some aspects, the actuator assembly can include a locking mechanism that prevents a release latch from being released from its engagement with a primary piston in response to the pressure signal being above the predetermined pressure range of the predetermined pressure window. The locking mechanism can prevent the primary piston from releasing the release latch by blocking the primary piston from moving in a first direction in response to the pressure signal being greater than the predetermined pressure range. The locking mechanism can block the movement of the primary piston by securing the locking mechanism in place adjacent to the primary piston by preventing the movement of the locking mechanism with at least one additional piston, for example a locking piston. In some aspects, a latch mechanism can also retain the locking mechanism in place in conjunction with the locking piston.

In some aspects, a spring coupled to the primary piston can exert a force on the primary piston in a second direction. The force exerted by the spring can prevent the primary piston from moving a predetermined amount in the first direction (and thereby releasing the release latch) in response to the pressure signal being less than the predetermined pressure range. In some aspects, the force exerted by the spring can prevent the primary piston from moving the predetermined amount in the first direction in response to the pressure signal being applied less than the predetermined amount of time.

Thus, through a series of springs, piston, and latches, the actuator assembly can control the release of a release latch that is coupled to the actuator. In response to an application of a pressure signal from the surface that falls within the predetermined pressure window, the actuator assembly can release the release latch and actuate the ball valve mechanism. In response to an application of a pressure signal from the surface that falls outside of the predetermined pressure window, for example being greater than the predetermined pressure range, being less than the predetermined pressure range, or being less than the predetermined time period of application of the pressure signal, the actuator assembly can retain the release latch in place and the ball valve mechanism may not actuate.

FIG. 1 is a schematic illustration of a well system 100 that includes a bore that is a wellbore 102 extending through various earth strata. The wellbore 102 has a substantially vertical section 104 that may include a casing string 106 cemented at an upper portion of the substantially vertical section 104. The well system 100 may include an upper completion 108 positioned proximate to the casing string 106. The well system 100 may also include a lower completion string 110 positioned below the upper completion 108. A downhole tool 114 may be positioned within the well system 100 below the lower completion string 110. The downhole tool 114 may be a flow control device, a circulating sub, or any other suitable downhole tool. The downhole tool 114 may include an open position in which a ball valve mechanism is in an open position. In the open position fluid may flow from a surrounding formation 116 through the ball valve mechanism into an inner region of the downhole tool 114. The downhole tool 114 may also include a closed position in which the ball valve mechanism is in a closed position. In the closed position fluid flow may be prevented from flowing from the surrounding formation 116 through ball valve mechanism into the inner region of the downhole tool 114. In the closed position, the downhole tool 114 may isolate the well system 100 from the surrounding formation 116. For example, the downhole tool 114 in the closed position may isolate the wellbore 102 from the surrounding formation 116 prior to installing the lower completion string 110.

The downhole tool 114 may be moved from the closed position to the open position in response to a signal from the surface of the wellbore 102. The signal from the surface may be a predetermined pressure signal from the surface. The predetermined pressure signal may fall within a "pressure window" that corresponds to a predetermined pressure range. The pressure window may also correspond to the predetermined pressure range being applied for a predetermined amount time. A pressure signal that falls outside of the predetermined pressure window, either by falling outside of the predetermined pressure range of pressure or predetermined amount of time of application may not cause the downhole tool 114 to actuate. A pressure signal that falls within the predetermined pressure window may cause the downhole tool 114 to actuate. The downhole tool 114 may be a mechanical tool that does not utilize electronics.

Figure 2:
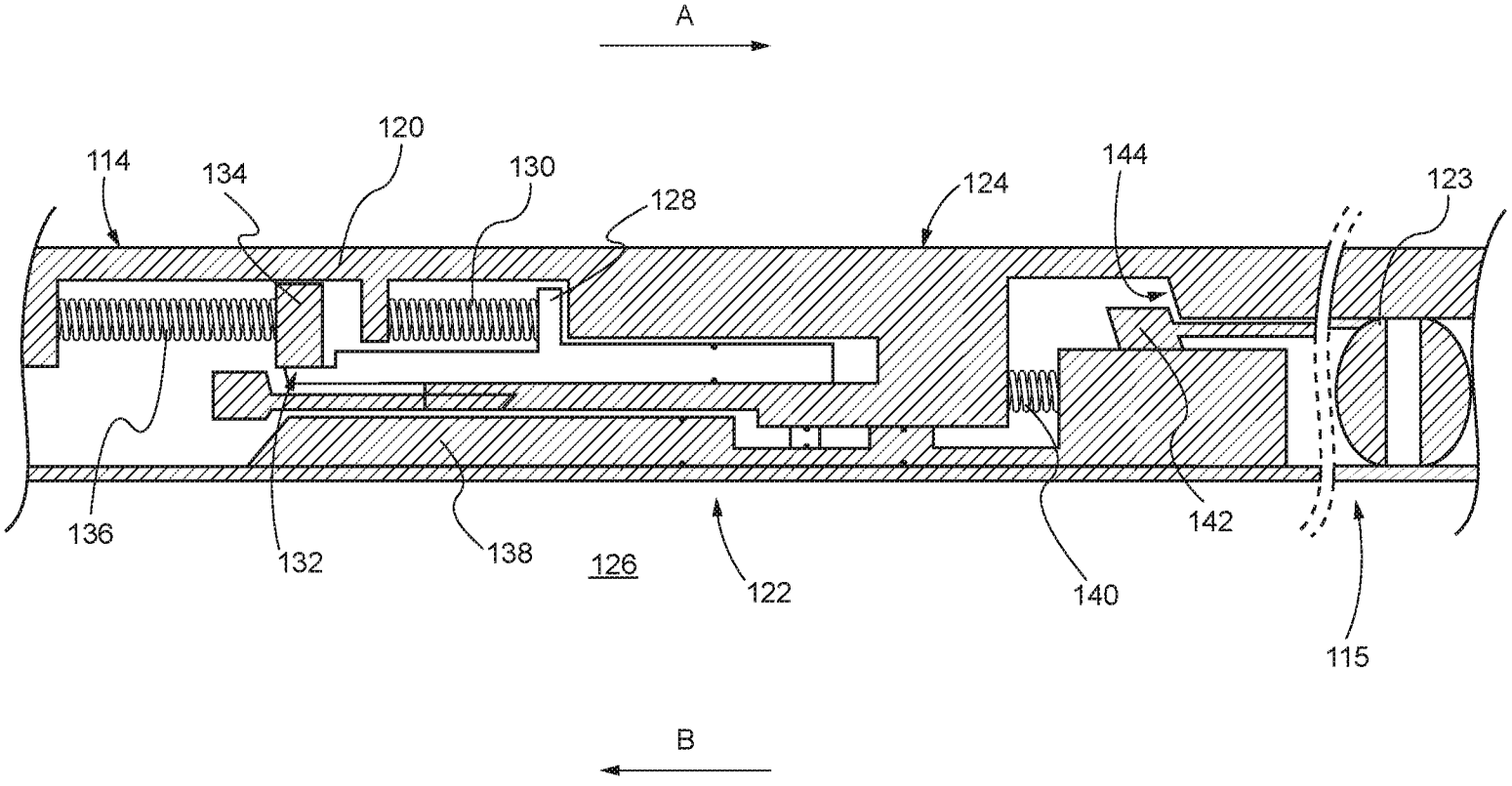
FIG. 2 is a cross-sectional side view of a portion of the downhole tool of FIG. 1 in a first position, according to an aspect of the present disclosure.

FIG. 2 depicts a cross-sectional side view of a portion of the downhole tool 114 in a first position according to an aspect of the present disclosure. The downhole tool 114 may be, for example, but not limited to, a flow control device. The downhole tool 114 may include a tubing string 120, a ball valve mechanism 115, and an actuator assembly 122 for controlling the position of the ball valve mechanism 115. In some aspects, the downhole tool 114 may have additional features or elements. The downhole tool 114 may be in the open position when the ball valve mechanism 115 is in an open position to permit fluid flow from the formation through an outer surface 124 of the tubing string 120 to an inner region 126 of the tubing string 120. The downhole tool 114 may be in the closed position when the ball valve mechanism 115 is in a closed position to prevent fluid flow from the outer surface 124 to the inner region 126 of the tubing string 120. In the closed position, the downhole tool 114 may isolate a well system from a surrounding formation. For example, the downhole tool 114 in the closed position may isolate the wellbore (shown in FIG. 1) from the formation prior to installing the lower completion string.

The actuator assembly 122 of the downhole tool 114 can control the position of the ball valve mechanism 115, for example by opening the ball valve mechanism 115 in response to an application of a predetermined pressure signal from the surface of the wellbore. The ball valve mechanism 115 can include a ball valve 123, shown in FIG. 2 in the closed position. The position of the ball valve mechanism 115 can correspond to the position of the ball valve 123. The predetermined pressure signal can correspond to a predetermined pressure range and can also correspond to the predetermined pressure range being applied for a predetermined amount of time. In some aspects, actuation of the actuator assembly 122 may move the downhole tool 114 from an open position to a closed position or vice versa.

The actuator assembly 122 is shown in FIG. 2 in the first position in which no pressure signal from the surface is applied or in which a pressure signal that falls outside the predetermined pressure window is applied. For example, the amount of the pressure signal (e.g. the amount of pressure being applied from the surface) may be less than the predetermined range of pressure. In some aspects, the pressure signal may be applied for an amount of time that is less than the predetermined amount of time for the pressure window. The actuator assembly 122 includes a locking piston 128 that is coupled to a first spring 130. The first spring 130 has a spring force in a first direction indicated by the arrow "A" in FIG. 2. The locking piston 128 also engages on a first end 132 with a latch 134. The latch 134 is coupled to a second spring 136 that has a spring force in the first direction. At the first position shown in FIG. 2, with no or low pressure (i.e. pressure lower than the predetermined pressure range) being applied from the surface, the latch 134 may not overcome the spring force of the second spring 136 to move in the second direction opposite the first direction. Nor may the locking piston 128 move in the first direction as the force of the pressure signal may not be sufficient to overcome the spring force of the first spring 130 and the second spring 136 to permit the locking piston 128 to move in the second direction.

The actuator assembly 122 also includes a primary piston 138 that is also coupled to a return spring 140. The return spring 140 has a spring force in the first direction (shown by arrow "A"). The ball valve mechanism 115 includes, or in some aspects is coupled to, a release latch 142 that is positioned between the outer surface 124 of the tubing string 120 and the primary piston 138 and is releasably secured in place by a projection 144 of the tubing string 120 and by the primary piston 138, as shown in FIG. 2. The release latch 142 may also be coupled to a spring (not shown), for example, but not limited to, by locking-dog mechanisms or other similar devices. In the first position of the actuator assembly 122 shown in FIG. 2, the release latch 142 may retain the spring (not shown) in place. Upon release of the release latch 142 the spring (not shown) can release and cause the ball valve mechanism 115 to be actuated. In some aspects, the applied pressure causes the ball valve mechanism 115 to be actuated. Thus, the release of release latch 142 from its restrained position between the primary piston 138 and the projection 144 may actuate the ball valve mechanism 115 of the downhole tool 114.

As shown in FIG. 2, with the amount of the pressure signal being below the predetermined pressure range of the predetermined pressure window, the force exerted on the primary piston 138 by the pressure signal may not be sufficient to overcome the spring force of the return spring 140 to move the primary piston 138 a predetermined amount in the second direction to release the release latch 142. Thus, the primary piston 138 may not move the predetermined amount in the second direction (shown by the arrow "B") to release the release latch 142. The release latch 142 thereby remains restrained by the position of the primary piston 138 and by the projection 144 and may not move in the first direction to cause the ball valve mechanism 115 to actuate. Thus, when an application of pressure from the surface (also referred to as the pressure signal) is lower than a predetermined range of pressure associated with the predetermined pressure window the release latch 142 may remain restrained by the primary piston 138 and the projection 144, and the ball valve mechanism 115 may not actuate.

Figure 3:
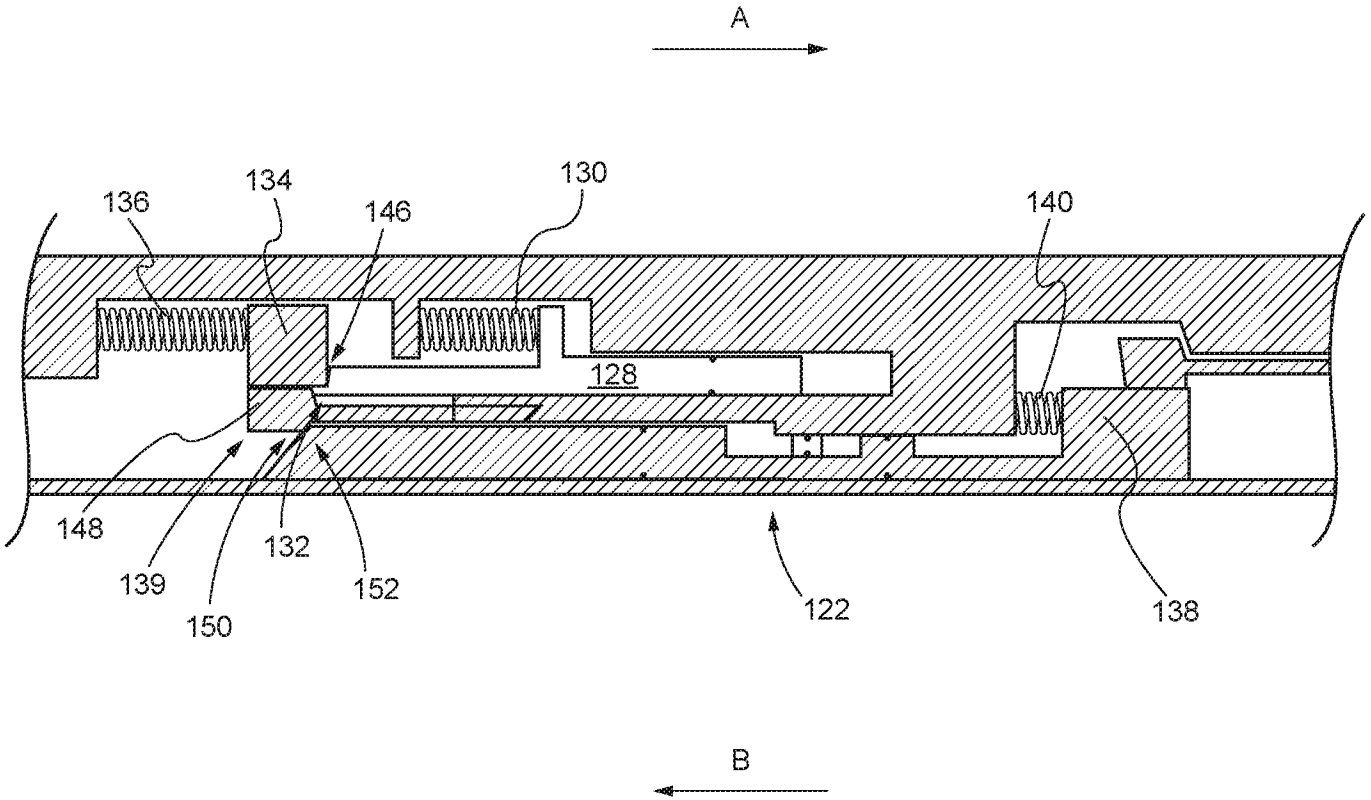
FIG. 3 is a cross-sectional side view of a portion of the downhole tool of FIG. 1 in a second position, according to an aspect of the present disclosure.

FIG. 3 depicts a cross-sectional side view of a portion of the downhole tool 114 in a second position according to an aspect of the present disclosure. In the second position shown in FIG. 3, a pressure signal from the surface is applied to the actuator assembly 122. As shown in FIG. 3, the pressure signal may be greater than the predetermined pressure range for the predetermined pressure window for actuation of the downhole tool 114. The pressure signal from the surface, being greater than the predetermined pressure window, can force the locking piston 128 in the second direction (shown by arrow "B") overcoming the spring force of the first spring 130. The movement of the locking piston 128 in the second direction in combination with the pressure signal can force the latch 134 to move in the second direction. The movement of the latch 134 can position the latch 134 up against a projection 146 on the first end 132 of the locking piston 128 causing the locking piston 128 and the latch 134 to become engaged together in a locked position.

The movement of the locking piston 128 in the second direction (shown by arrow "B") can also cause the first end 132 of the locking piston 128 to engage with a surface of a locking mechanism 148. The latch 134 can also be engaged with a surface of the locking mechanism 148 for restraining the locking mechanism 148 in place. The engagement between the locking piston 128, the latch 134, and the locking mechanism 148 can maintain the locking mechanism 148 in a restrained position that prevents the primary piston 138 from moving in the second direction beyond an end 139 of the locking mechanism 148. As shown in FIG. 3, for example, the primary piston 138 may be prevented from moving further in the second direction (shown by arrow "B") by engagement between a projection 150 of the locking mechanism 148 and an end 152 of the primary piston 138. The locking mechanism 148 may also be restrained from moving in an upwards direction away from the primary piston 138 by the latch 134 which is also restrained in place in its own engagement with the locking piston 128 and the force of the spring 136. Thus, the various strengths and series of springs, latches, and pistons of the actuator assembly 122 can restrain the primary piston 138 in a position that can prevent the release latch 142 from releasing and actuating the ball valve mechanism 115 of the downhole tool 114 when a pressure signal from the surface is greater than the predetermined pressure window.

Figure 4:
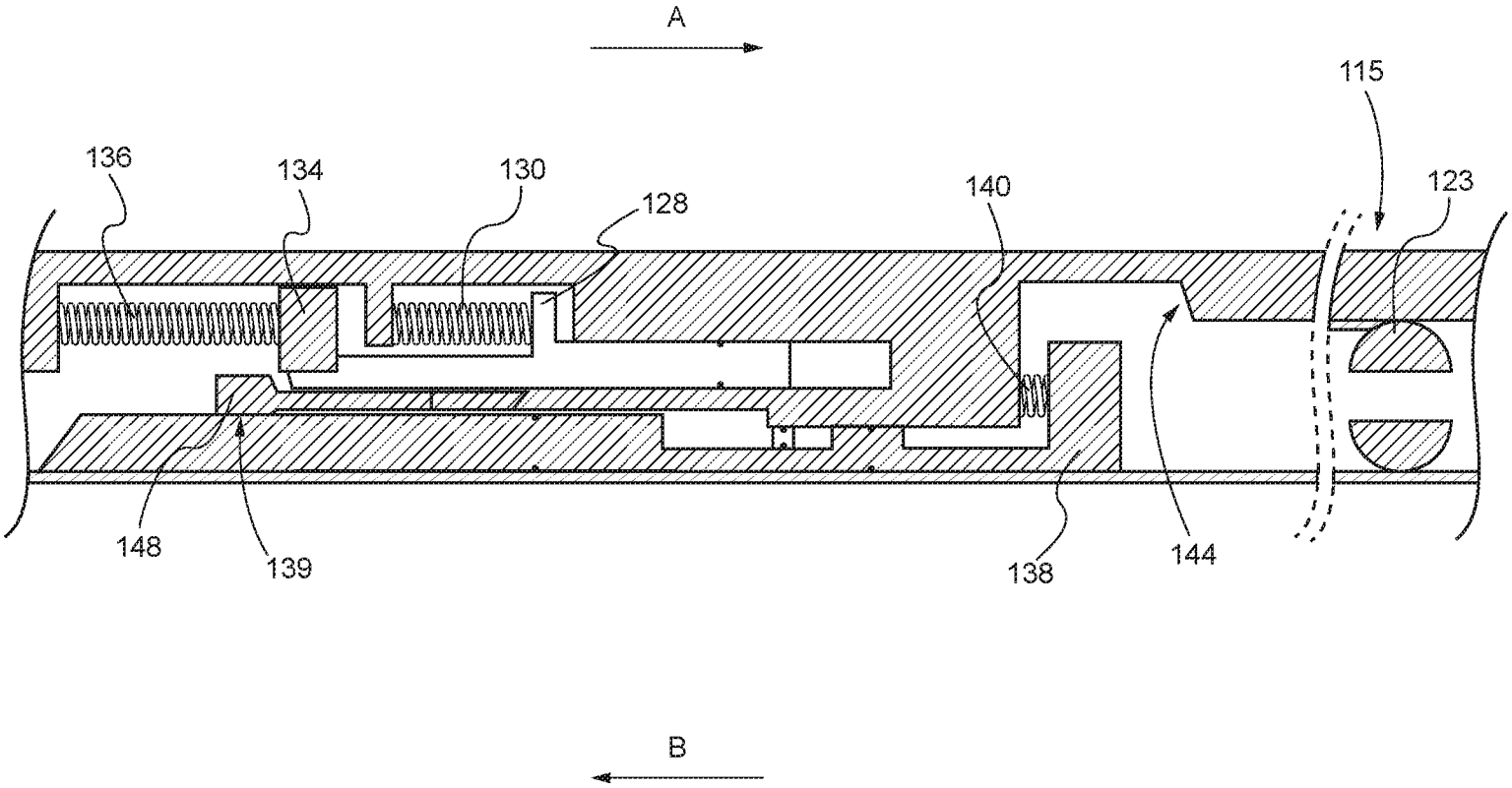
FIG. 4 is a cross-sectional side view of a portion of the downhole tool of FIG. 1 in a third position, according to an aspect of the present disclosure.

FIG. 4 depicts a cross-sectional side view of a portion of the downhole tool 114 in a third, release position according to an aspect of the present disclosure. In the third, release position shown in FIG. 4, a pressure signal from the surface is applied to the actuator assembly 122 in an amount that falls within the predetermined pressure range for the predetermined pressure window. The pressure signal falling with the predetermined pressure window can be large enough to overcome the force exerted by the return spring 140 in the first direction (shown by arrow "A") to force the primary piston 138 in the second direction (shown by arrow "B"). The pressure signal can be applied for an amount of time that falls within the predetermined pressure window to force the primary piston 138 in the first direction in a predetermined amount to cause the release latch 142 (shown in FIG. 2) to be released from its position between the primary piston 138 and the projection 144.

The pressure signal that falls within the predetermined pressure window can also be small enough that it may not overcome the spring force of the first spring 130 and the spring force of the second spring 136 and thereby may not cause the locking piston 128 to move in the second direction. For example, the force exerted by the pressure signal may not be sufficient to cause the locking piston 128 to move in the second direction because of the force exerted on the locking piston by the spring force of the first spring 130, as well as the force of the second spring 136 that is coupled to the latch 134.

The locking mechanism 148 can be in an unrestrained positioned when it is disengaged from the latch 134 and the locking piston 128 when the locking piston 128 is in the position shown in FIG. 4 in response to the pressure signal being insufficient to force the piston in the second direction in an amount sufficient to lock the locking mechanism 148 into engagement with the latch 134 and the locking piston 128. The pressure signal from the surface, falling within the predetermined pressure window, can thereby force the primary piston 138 in the second direction a predetermined amount. The movement of the primary piston 138 can force the locking mechanism 148 up towards the outer surface 124 of the tubing string 114 as the primary piston 138 moves in the second direction the predetermined amount. The locking mechanism 148 may be permitted to move upwards towards the outer surface 124 of the tubing string 114 because the latch 134 and locking piston 128 are not engaged with the locking mechanism 148 (see the position of the locking mechanism 148 in FIG. 3 as compared to FIG. 4). The primary piston 138 can thereby move in the second direction beyond the end 139 of the locking mechanism 148 causing the release latch 142 to be released from its position between the projection 144 and the primary piston 138. The release latch 142 is not shown in FIG. 4 as it has been released and has moved in the first direction shown by arrow "A". The release of the release latch 142 can actuate the ball valve mechanism 115 of the downhole tool 114, as shown in FIG. 4 such that the ball valve 123 of the ball valve mechanism 115 is in the open position. In some aspects, the primary piston 138 may not move in the second direction (shown by arrow "B") the predetermined amount when the pressure signal is within the predetermined pressure range but is not maintained for the predetermined amount of time. In such an instance, the release latch 142 may fail to be released. Thus, in some aspects, the pressure signal must fall within the predetermined pressure range and also be maintained for a predetermined amount of time to cause the release latch 142 to release and actuate the actuator.

As used below, any reference to a series of examples is to be understood as a reference to each of those examples disjunctively (e.g., "Examples 1-4" is to be understood as "Examples 1, 2, 3, or 4").

Example 1 is a downhole tool positionable within a wellbore, the downhole tool comprising: a tubing string positionable downhole in the wellbore and having an outer surface that defines an inner region and an outer region of the tubing string; a release latch positioned within an inner region of the tubing string, the release latch having a restrained position and a released position, the release latch being coupled to a ball valve mechanism for actuating the ball valve mechanism in the released position; and a primary piston positioned within the inner region of the tubing string and coupled to a spring to exert a force in a first direction, the primary piston being movable a predetermined amount in a second direction to move the release latch from the restrained position to the released position in response to an application of a predetermined amount of pressure over a predetermined amount of time from a surface of the wellbore.

Example 2 is the downhole tool of example 1, wherein the second direction is opposite the first direction.

Example 3 is the downhole tool of examples 1 or 2, further comprising: a locking piston coupled to a second spring; and a locking mechanism positioned between the primary piston and a locking piston for preventing movement of the primary piston the predetermined amount in the second direction in response to an application of pressure from the surface of the wellbore that is greater than the predetermined amount of pressure.

Example 4 is the downhole tool of example 3, further comprising a latch coupled to a third spring and having a surface that engages with a surface of the locking mechanism in response to the application of pressure that is greater than the predetermined amount of pressure.

Example 5 is the downhole tool of example 4, wherein the latch includes a surface that engages with a surface of the locking piston in response to the application of pressure that is greater than the predetermined amount of pressure.

Example 6 is the downhole tool of example 4, further comprising a projection on the locking mechanism that engages with an end of the locking piston and a surface of the latch in response to the application of pressure that is greater than the predetermined amount of pressure.

Example 7 is the downhole tool of any of examples 1-3, wherein the spring coupled to the primary piston has a spring force selected to prevent the primary piston from moving the predetermined amount in the second direction in response to an application of pressure that is less than the predetermined amount of pressure.

Example 8 is an actuation assembly positionable within a wellbore, the actuation assembly comprising: a primary piston coupled to a first spring and positionable in a first position in which the primary piston is coupled to a release latch for restraining the release latch from actuating a ball valve mechanism; a locking piston coupled to a second spring; and a locking mechanism positioned between the primary piston and the locking piston; wherein the locking mechanism is moveable between (i) a restrained position for preventing the primary piston from moving a predetermined amount in a first direction in response to an application of pressure from a surface of the wellbore that is greater than a predetermined amount of pressure and (ii) an unrestrained position.

Example 9 is the actuation assembly of example 8, wherein the predetermined amount of pressure is a predetermined pressure range.

Example 10 is the actuation assembly of examples 8 or 9, wherein the first spring coupled to the primary piston has a spring force selected to permit the piston to move the predetermined amount in the first direction in response to the application of pressure from the surface of the wellbore that is within the predetermined pressure range for a predetermined period of time.

Example 11 is the actuation assembly of any of examples 8-10, further comprising a latch positionable in a locked position in which the latch contacts a surface of the locking mechanism for maintaining the locking mechanism in the restrained position in response to the application of pressure from the surface of the wellbore that is greater than the predetermined amount of pressure.

Example 12 is the actuation assembly of example 11, further comprising a third spring coupled to the latch for maintaining the latch in the first position in response to the application of pressure from the surface of the wellbore that is greater than the predetermined amount of pressure.

Example 13 is the actuation assembly of example 12, wherein the locking mechanism is held in the restrained position by a surface of the latch and a surface of the locking piston in response to the application of pressure from the surface of the wellbore that is greater than the predetermined amount of pressure.

Example 14 is the actuation assembly of any of examples 8-13, wherein the first spring has a spring force selected to compress the first spring a predetermined amount in response to an application of pressure from the surface of the wellbore that falls within a predetermined pressure range for uncoupling the release latch from the primary piston.

Example 15 is the actuation assembly of example 10, wherein the first spring has a spring force selected to compress the first spring a predetermined amount in response to an application of pressure from the surface of the wellbore that falls within the predetermined pressure range for the predetermined period of time for uncoupling the release latch from the primary piston.

Example 16 is the actuation assembly of example 12, wherein the second and third springs have a combined spring force that is greater than the predetermined pressure range for maintaining the locking mechanism in a released position in which an end of the primary piston can extend longitudinally beyond an end of the locking mechanism.

Example 17 is a method of actuating a tool positioned downhole in a wellbore, the method comprising: applying a pressure from a surface of the wellbore to the tool downhole; moving a primary piston a predetermined amount in response to the pressure being within a predetermined pressure range; and releasing a latch coupled to a ball valve mechanism in response to the primary piston moving the predetermined amount for actuating the ball valve mechanism.

Example 18 is the method of actuating a tool positioned downhole in a wellbore of example 17, wherein the pressure from the surface is maintained for a predetermined amount of time.

Example 19 is the method of actuating a tool positioned downhole in a wellbore of any of examples 17-19, further comprising: moving a locking mechanism in a first direction in response to the primary piston moving the predetermined amount.

Example 20 is the method of actuating a tool positioned downhole in a wellbore of example 19, wherein the locking mechanism is positionable in a restrained position for preventing the primary piston from moving the predetermined amount in response to an application of pressure from the surface that is greater than the predetermined pressure range.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

That which is claimed is:

1. A downhole tool positionable within a wellbore, the downhole tool comprising:

a tubing string positionable downhole in the wellbore and having an outer surface that defines an inner region and an outer region of the tubing string;

a release latch positioned within the inner region of the tubing string, the release latch having a restrained position and a released position, the release latch being coupled to a ball valve mechanism for actuating the ball valve mechanism in the released position;

a primary piston positioned within the inner region of the tubing string and coupled to a spring to exert a force in a first direction, the primary piston being movable a predetermined amount in a second direction to move the release latch from the restrained position to the released position in response to an application of a predetermined amount of pressure over a predetermined amount of time from a surface of the wellbore;

a locking piston coupled to a second spring; and a locking mechanism positioned between the primary piston and the locking piston, the locking piston positionable in a restrained position to aid in preventing the primary piston from moving the predetermined amount in the second direction in response to an application of pressure from the surface of the wellbore that is greater than the predetermined amount, wherein a shoulder of the locking mechanism is engaged with a portion of the locking piston in the restrained position.

2. The downhole tool of claim 1, wherein the second direction is opposite the first direction.

3. The downhole tool of claim 1, further comprising a latch coupled to a third spring and having a surface that engages with a surface of the locking mechanism in response to the application of pressure that is greater than the predetermined amount of pressure.

4. The downhole tool of claim 3, wherein the latch includes a surface that engages with a surface of the locking piston in response to the application of pressure that is greater than the predetermined amount of pressure.

5. The downhole tool of claim 3, further comprising a projection on the locking mechanism that engages with an end of the locking piston and a surface of the latch in response to the application of pressure that is greater than the predetermined amount of pressure.

6. The downhole tool of claim 1, wherein the spring coupled to the primary piston has a spring force selected to prevent the primary piston from moving the predetermined amount in the second direction in response to an application of pressure that is less than the predetermined amount of pressure.

7. The downhole tool of claim 1, wherein the predetermined amount of pressure is a predetermined pressure range.

8. An actuation assembly positionable within a wellbore, the actuation assembly comprising:

a primary piston coupled to a first spring and positionable in a first position in which the primary piston is coupled to a release latch for restraining the release latch from actuating a ball valve mechanism;

a locking piston coupled to a second spring; and a locking mechanism positioned between the primary piston and the locking piston; wherein the locking mechanism is moveable between (i) a restrained position for preventing the primary piston from moving a predetermined amount in a first direction via at least in part the engagement of a shoulder of the locking mechanism with a portion of the locking piston in response to an application of pressure from a surface of the wellbore that is greater than a predetermined amount of pressure for preventing the ball valve mechanism from actuating and (ii) an unrestrained position for permitting the primary piston to move the predetermined amount in the first direction in response to an application of pressure from the surface being the predetermined amount of pressure for actuating the ball valve mechanism.

9. The actuation assembly of claim 8, wherein the predetermined amount of pressure is a predetermined pressure range.

10. The actuation assembly of claim 9, wherein the first spring coupled to the primary piston has a spring force selected to permit the piston to move the predetermined amount in the first direction in response to the application of pressure from the surface of the wellbore that is within the predetermined pressure range for a predetermined period of time.

11. The actuation assembly of claim 10, wherein the first spring has a spring force selected to compress the first spring a predetermined amount in response to an application of pressure from the surface of the wellbore that falls within the predetermined pressure range for the predetermined period of time for uncoupling the release latch from the primary piston.

12. The actuation assembly of claim 9, further comprising a latch positionable in a locked position in which the latch contacts a surface of the locking mechanism for maintaining the locking mechanism in the restrained position in response to the application of pressure from the surface of the wellbore that is greater than the predetermined amount of pressure.

13. The actuation assembly of claim 12, further comprising a third spring coupled to the latch for maintaining the latch in the first position in response to the application of pressure from the surface of the wellbore that is greater than the predetermined amount of pressure.

14. The actuation assembly of claim 13, wherein the locking mechanism is held in the restrained position by a surface of the latch and a surface of the locking piston in response to the application of pressure from the surface of the wellbore that is greater than the predetermined amount of pressure.

15. The actuation assembly of claim 13, wherein the second and third springs have a combined spring force that is greater than the predetermined pressure range for maintaining the locking mechanism in a released position in which an end of the primary piston can extend longitudinally beyond an end of the locking mechanism.

16. The actuation assembly of claim 9, wherein the first spring has a spring force selected to compress the first spring a predetermined amount in response to an application of pressure from the surface of the wellbore that falls within a predetermined pressure range for uncoupling the release latch from the primary piston.

17. A method of actuating a tool positioned downhole in a wellbore, the method comprising:

applying a pressure from a surface of the wellbore to the tool downhole;

moving a primary piston a predetermined amount in response to the pressure being within a predetermined pressure range;

maintaining a locking mechanism in an unrestrained position in response to the pressure being within the predetermined pressure range such that the locking mechanism permits the primary piston to move the predetermined amount, wherein the locking mechanism has a restrained position in which it prevents the primary piston from moving the predetermined amount in response to the pressure being greater than the predetermined pressure range; and releasing a latch coupled to a ball valve mechanism in response to the primary piston moving the predetermined amount for actuating the ball valve mechanism.

18. The method of actuating the tool positioned downhole in a wellbore of claim 17, wherein the pressure from the surface is maintained for a predetermined amount of time.

19. The method of actuating the tool positioned downhole in a wellbore of claim 18, further comprising:

moving a locking mechanism in a first direction toward an outer surface of the tool in response to the primary piston moving the predetermined amount.

20. The method of actuating the tool positioned downhole in a wellbore of claim 19, wherein the locking mechanism is positionable in a restrained position in which it is restrained at least in part by a shoulder of the locking mechanism being engaged with a projection for preventing the primary piston from moving the predetermined amount in response to an application of pressure from the surface that is greater than the predetermined pressure range.

* * * * *